United States Patent [19]

Sauer et al.

[11] 4,453,195

[45] Jun. 5, 1984

[54] RELAY PLUG SOCKET

[75] Inventors: Hans Sauer, Deisenhofen, Del.X; Toyotaka Nishikawa, Ise, Japan; Johannes Oberndorfer, Hofsingelding, Fed. Rep. of Germany

[73] Assignees: SDS Elektro GmbH, Fed. Rep. of Germany; Matsushita Electric Works Ltd., Osaka, Japan

[21] Appl. No.: 305,891

[22] Filed: Sep. 25, 1981

[30] Foreign Application Priority Data

Sep. 26, 1980 [DE] Fed. Rep. of Germany ..... 3036404

[51] Int. Cl.[3] ..... H01H 50/04

[52] U.S. Cl. ..... 361/156; 361/160; 339/128; 339/198 K

[58] Field of Search ..... 361/156, 160, 400, 401, 361/417, 346; 339/176 MP, 128, 198 K

[56] References Cited

U.S. PATENT DOCUMENTS

| | | | |
|---|---|---|---|
| 3,337,836 | 8/1967 | Churla, Jr. | 339/128 |
| 3,514,743 | 5/1970 | Schantz | 339/128 |
| 3,812,450 | 5/1974 | Simovits, Jr. et al. | 339/128 |
| 4,154,498 | 5/1979 | Wood et al. | 339/128 |

FOREIGN PATENT DOCUMENTS

| | | | |
|---|---|---|---|
| 2559398 | 9/1976 | Fed. Rep. of Germany . | |
| 2747607 | 4/1979 | Fed. Rep. of Germany | 361/156 |
| 935465 | 8/1963 | United Kingdom . | |

*Primary Examiner*—Reinhard J. Eisenzopf
*Attorney, Agent, or Firm*—Anthony H. Handal

[57] ABSTRACT

A modular relay incorporated in a plugable element is disclosed. In accordance with the preferred embodiment, the relay is of the bistable type, and in response to actuation, is caused to switch state for a predetermined period of time, thus acting as a monostable device. Structure is disclosed for insuring that the state of the relay is known prior to actuation. A particularly advantageous mounting structure is incorporated within the relay comprising multi-step mounting feet. The energizing circuit in accordance with the invention is disposed within the plug socket.

7 Claims, 6 Drawing Figures

RELAY PLUG SOCKET

DESCRIPTION

Figure 1:
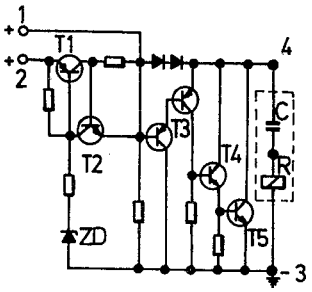

This invention relates to a relay plug socket of the type set forth in the introductory clause of claim 1.

Plug sockets of this type, particularly for relays of very small outer dimensions, are increasingly employed also in connection with printed circuit boards, in which case the small dimensions of the relays permit a high packing density to be obtained, i.e. narrow spacings between adjacent circuit boards. The circuit boards may carry discrete circuit elements and/or integrated circuits, in which case the latter may be directly employed for energization of the relay (cf. Dictionary of Mikro-Electronics, IWT-Verlag GmbH, München 1978, p. 608).

It is an object of the invention to improve a relay plug socket of the type set forth in the introductory clause of claim 1 in such a manner that it may be universally employed in connection with printed circuit boards as well as with conventional chassis.

In a plug socket of the disclosed type this object is attained by the provisions set forth in the characterizing clause of claim 1.

The relay plug socket according to the invention is thus characterized in that an electric circuit directly and individually associated with a relay to be plugged into the plug socket is integrated into said plug socket so as to form an electrical and mechanical unit with the plug socket. This enables the plug socket to be directly mounted on a conventional chassis or mounting frame in a particularly simple manner, as desirable for instance in the field of telecommunications, without the need to provide a separate printed circuit board immediately adjacent the relay or the plug socket, respectively, carrying for instance an energizing circuit individually associated with the respective relay.

In accordance with a preferred embodiment of the invention, said energizing circuit may be adapted to impart a monostable switching function to a bistable relay plugged into the socket. A bistable relay usually requiring two pulses for completing a switching cycle involving two functional conditions may thus be switched to one condition by an energizing pulse produced by the energizing circuit, and may be automatically switched back to the original state on termination of the energizing pulse without the occurrence of power consumption by the energizing circuit. On the other hand the employ of a bistable relay in connection with an energizing circuit of this type offers the advantage that the power consumption of the energizing circuit is very low after energization of the relay also in the continued presence of the energizing pulse. The power consumption of the energizing circuit is thus substantially limited to the responding delay of the relay.

In a preferred embodiment, the energizing circuit is formed of an integrated circuit and a capacitor connected in series with the relay. On energization of the relay the capacitor is charged, with the charging time being substantially equal to the responding delay. On termination of the energizing pulse the capacitor discharges through the integrated circuit, whereby the relay is energized in the opposite sense, i.e. switched back to its original state in the case of a bistable relay, without the energizing consuming any power to this effect.

Preferably, the energizing circuit is electrically integrated with the plug socket in such a manner that the junction between the relay and the capacitor is connected to a terminal pin of the plug socket, permitting the relay to be selectively energized in one direction or the other independently of the energizing circuit in order to set a bistable relay to a desired armature position. This possibility is important, as different circuit arrangements may require a specific set position of the bistable relay, while the actual set position of a bistable relay is wholly indeterminate at the time of delivery.

In an advantageous embodiment of the invention the plug socket is provided with resilient retainer arms for mechanically retaining the relay to be plugged into the socket, and with resilient mounting feet at its bottom portion permitting the plug socket to be fastened in a mounting opening of a mounting frame or chassis without the employ of separate fastening elements such as screws, springs or the like. The mounting feet resiliently engage the rear surface of a mounting base defining the mounting opening, and are to this effect provided with a number of steps in order to ensure a reliable snap-fit connection between the plug socket and the mounting base even if the mounting base portion surrounding the mounting opening is of varying thickness.

Further embodiments of the invention are set forth in the sub-claims.

Figure 2:
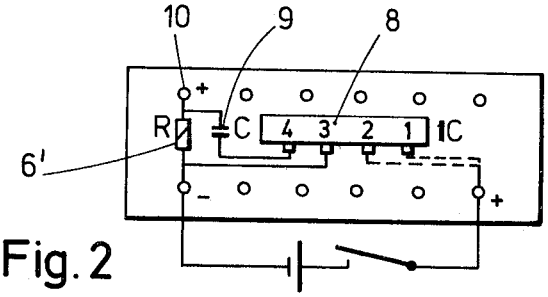
Figure 3:
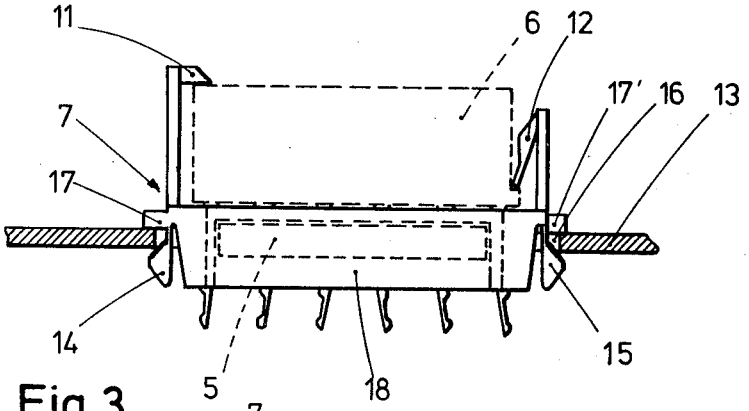
Figure 4:
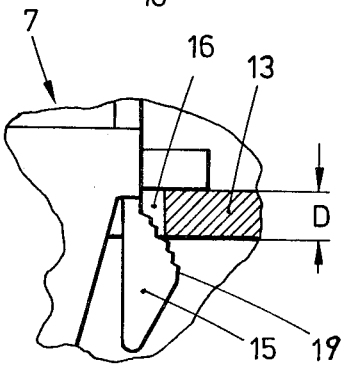
Figure 5:
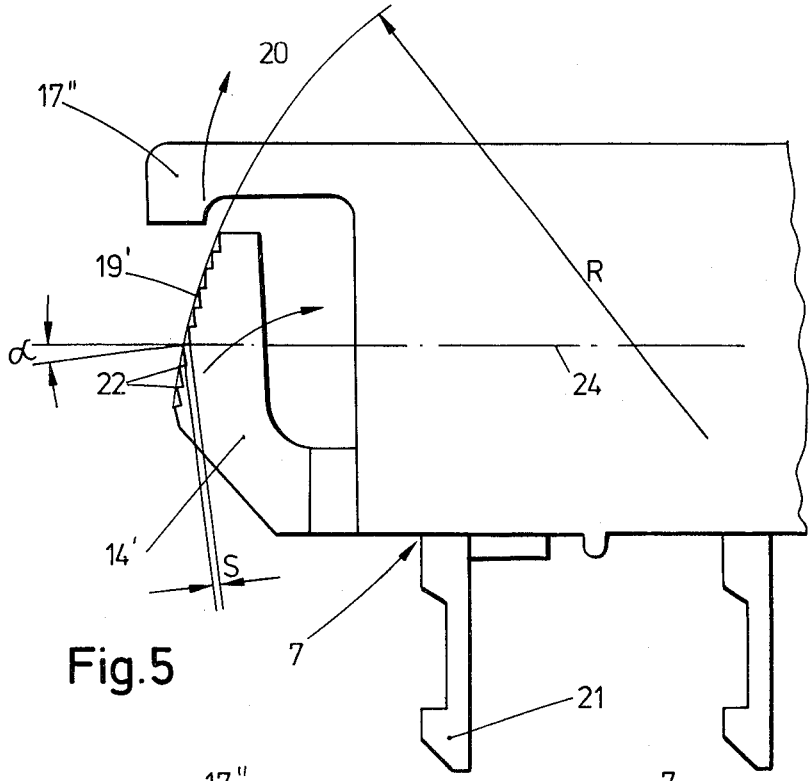
Figure 6:
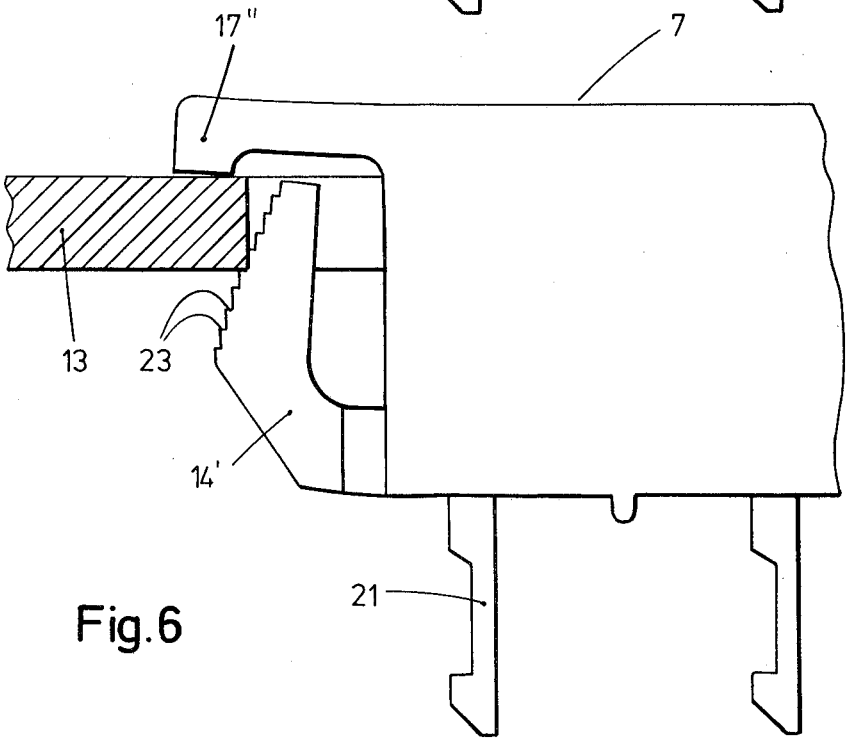

Embodiments of the invention shall now be described with reference to the accompanying drawings, wherein:

FIG. 1 shows a circuit diagram of an energizing circuit adapted to be integrated with the plug socket, FIG. 2 shows in diagrammatic form the electrical connection of the energizing circuit of FIG. 1 with the plug socket, FIG. 3 shows the fastening of the plug socket to a mounting base, FIG. 4 shows an enlarged detail of FIG. 3, FIG. 5 shows another embodiment of mounting feet employed for fastening the plug socket and FIG. 6 shows the mounting foot of FIG. 5 in engagement with a mounting base.

The circuit diagram shown in FIG. 1 as an example of an energizing circuit adapted to be integrated with the plug socket comprises a trigger circuit formed of transistors T1 and T2 and associated resistors, and a sweep circuit formed of transistors T3, T4 and T5 and associated resistors. These circuit elements are united in an integrated circuit. The output of the integrated circuit is connected in series with a relay 6 adapted to be plugged into the plug socket and comprising a coil resistor R and a capacitor C. The capacity of capacitor C is selected in view of the coil resistor R of the plug-in relay so that its charging time constant is of similar magnitude as the responding delay of the relay. In this manner it is possible to limit the power consumption for applying the energizing voltage substantially to the responding time of the relay. After response of the relay the power consumption is restricted to the flow of leak currents of up to 100 uA as long as the energizing circuit is switched on. On interruption of the energizing voltage, capacitor C discharges through the sweep circuit formed of transistors T3, T4 and T5. This causes the relay to be energized in the opposite sense and to be reset thereby to its original position.

The trigger circuit formed of transistors T1 and T2 permits energizing voltages having gradually rising or sloping flanks to be applied to the input 2 of the energizing circuit. In this case a Zener diode ZD serves to establish definite energizing and deenergizing values. If the flanks of the energizing voltage are sufficiently steep, the relay may also be energized via input 1, i.e. under circumvention of the trigger circuit.

An energizing circuit of the described type, which is mechanically and electrically integrated with the plug socket, permits a bistable relay plugged into the socket to be imparted a monostable switching behavior, since on termination of the energizing voltage the relay 6 is energized in the opposite sense and thereby reset to its original state by the discharge of capacitor C through the sweep circuit. In addition, this energizing circuit ensures that the power consumption is restricted to minimal leak currents after energization of the relay, so that neither the relay nor the energizing circuit itself develop any significant heat, and an energy saving of up to 99 percent is achieved.

FIG. 2 shows in diagrammatic form the electrical connection of the circuit shown in FIG. 1 with the terminal pins of the plug socket. In this figure it is to be noted that the junction between capacitor 9 and relay 6' is connected to a terminal pin 10. This allows an energizing voltage of preselected polarity to be directly applied to relay 6' independently of the energization through the energizing circuit, in order for instance to set a bistable relay plugged into the socket to a desired starting position. Since a bistable relay is usually supplied with its armature at a random position, while many circuit arrangements prescribe a specific armature position and a specific contact position associated therewith, the possibility of electrically setting the relay to the desired armature position constitutes a considerable advantage. In FIG. 2 the terminals of the integrated circuit are designated by numerals 1, 2, 3, and 4 in keeping with the circuit diagram of FIG. 1. The energizing voltage to be applied to the energizing circuit is diagrammatically represented in FIG. 2 by a voltage source and associated switch.

FIG. 3 shows the plug socket 7 mounted on a mounting base 13 such as a plate-shaped member of a chassis or a mounting frame. Mounting base 13 is provided with a mounting opening 16 for receiving the bottom portion of plug socket 7 therein. The plug socket is supported on the upper surface of mounting base 13 by means of flanges 17, 17', with a pair of resilient mounting feet 14, 15 connected to it bottom portion project through mounting opening 16 to resiliently engage the lower surface of mounting base 13, whereby the plug socket is positively retained on the mounting base without the need for separate fastening elements such as screws, springs or the like. This fastening arrangement and the configuration of the mounting feet is shown in FIG. 4 at an enlarged scale. At their side facing towards the underside of mounting base 13, the mounting feet may be provided with a series of steps 19 to ensure a substantially play-free engagement and thus positive retention of the mounting feet even if the thickness D of the mounting base 13 employed varies.

As further shown in FIG. 3, plug socket 7 is additionally provided with retainer arms 11 and 12 resiliently connected to the body of socket 7, retainer arm 12 being provided with a schematically indicated reentrant spring member acting as a leaf spring. The retainer arms 11 and 12 permit the relay plugged into the socket to be reliably retained, so that it is prevented from dropping off under the influence of shock and vibration such as may occur if the assembly is employed in a vehicle.

FIG. 3 of the drawings also shows that flanges 17, 17' as well as mounting feet 14, 15 are integrally formed with the bottom portion of socket 7 diagonally opposite each other, so that the socket body may be formed by using a simple two-piece mould without a follower.

The arrangement of the energizing circuit within the plug socket is diagrammatically shown in FIG. 3 by broken lines. The circuit may be inserted in a simple manner into an opening 18 formed in the bottom portion of plug socket 7.

A different embodiment of the mounting feet is shown in FIGS. 5 and 6. The mounting foot 14' shown is connected to the bottom portion of plug socket 7 carrying the terminal pins 21, and extends upwards in the drawing, i.e. in a direction opposite to that of the terminal pins. The associated flange 17'' is resiliently connected to the plug socket so as to be resiliently deflectable. The steps 19' of mounting foot 14' are located along a circular arc 20 having a radius R so as to enable a greater number of such steps on a mounting foot of given dimensions. As clearly shown in FIG. 5, the engagement surfaces 23 of steps 19' in the relaxed state of mounting foot 14' are each inclined by an angle $\alpha$ with respect to a plane 24 extending substantially parallel to the plane of mounting base 13. At the first step 19' adjacent the free end of mounting foot 14', angle $\alpha$ is 0°, increasing from step to step towards the end of mounting foot 14' connected to plug socket 7 to a value of about 13° at the lowermost step 19' in the drawing.

As clearly shown in FIG. 6, the described inclination of the steps' engagement surfaces ensures that on elastic bending of the mounting foot towards the plug socket the engagement surface of the step engaging the mounting base 13 extends substantially parallel to the adjacent surface of mounting base 13. Since flange 17'' is also resiliently connected to plug socket 7, the socket is retained substantially free of play within the opening of mounting base 13, as also evident from FIG. 6.

The location of steps 19' or their edges 22, respectively, along circular arc 20 permits a greater number of steps to be provided on a mounting foot 14' of given dimensions than would be feasible with a linear arrangement of steps. The depth S of the engagement surfaces 23 of steps 19' may be relatively small, their size being just sufficient to ensure reliable engagement of any given step with the edge of the opening in mounting base 13. This results in a correspondingly fine segmentation of the engagement surface of mounting foot 14', so as to ensure a substantially play-free retention of plug socket 7 in the opening of mounting base 13 in cooperation with the resilient flange 17''.

Although the plug socket has been described as being mounted on a mounting base in the form of a chassis or a mounting frame, the same plug socket may of course be inserted into an opening of a printed circuit board, so that it is highly versatile in use.

Although further the circuit integrated with the plug socket has been described as an energizing circuit, it is of course possible to enclose other circuits within the plug socket, such as for instance an output circuit cooperating with the relay contacts.

We claim:

1. A relay plug socket, comprising:

(a) means for receiving a relay;

(b) terminal pin means for electrically connecting to an external circuit;

(c) fastening element means for connecting to a mounting base; and (d) an internal circuit integrated with said plug socket, said internal circuit comprising an energizing circuit for a relay of the bistable type, said energizing circuit being configured to impart a monostable switching function to said bistable relay plugged into said plug socket, said energizing circuit comprising an integrated circuit and a capacitor connected to drive said plug-in relay, said relay and said capacitor being joined at a common electrical junction, the junction between the capacitor and the relay being connected to a terminal pin permitting a bistable relay to be energized in a known armature position.

2. A plug socket according to claim 1, wherein said energizing circuit comprises an integrated circuit and at least one capacitor connected in series with the plug-in relay.

3. A plug socket according to claim 1, wherein the junction between the capacitor (9) and the plug-in relay is connected to a terminal pin permitting a bistable relay to be set to a specific armature position.

4. A plug socket according to claim 1, characterized in that it comprises resilient retaining arms adapted to engage the relay body of a plug-in relay and/or to partially surround it.

5. A plug socket according to claim 1, wherein said plug socket is provided with resiliently deflectable flanges adapted to engage the upper surface of said mounting base.

6. A plug socket according to claim 1, wherein said mounting base is a chassis or a mounting frame, respectively.

7. A plug socket as in claim 1, wherein said fastening element means is in the form of mounting feet resiliently connected to the bottom portion facing towards said mounting base and adapted to extend through an opening of said mounting base into engagement with the side of said mounting base facing away from said bottom portion, said mounting feet formed at their sides facing towards the respective narrower side of said mounting opening with a plurality of steps increasing their dimension in the direction of said narrower side, said mounting free being connected to an end portion of the plug socket extending through said mounting opening and carrying said terminal pin, with their free end extending backwards into said mounting opening, and the edges of said steps extending along a circular arc, the engagement surfaces of said steps being inclined by an angle with respect to a plane adjacent the free end of said mounting feet extending substantially parallel to the plane of said mounting base, said angle increasing from step to step, so that each of said engagement surfaces may engage the distant surface of said mounting base substantially parallel thereto.

* * * * *